US006062144A

United States Patent [19]

Benenowski et al.

[11] Patent Number: 6,062,144

[45] Date of Patent: May 16, 2000

[54] METHOD AND MEANS FOR THE ELASTIC BENDING OF A SUPPORT FOR A FLEXIBLE SWITCH

[75] Inventors: Sebastian Benenowski, Butzbach; Hans-Ulrich Dietze, Wusterwitz; Erich Nuding, Aalen; Stefan Schmedders, Essen; Rüdiger Ziethen, Friedrichsdorf, all of Germany

[73] Assignee: BWG Butzbacher Weichenbau GmbH, Butzbach, Germany

[21] Appl. No.: 08/442,413

[22] Filed: May 16, 1995

[30] Foreign Application Priority Data

May 16, 1994 [DE] Germany ..... 44 16 820

[51] Int. Cl.[7] ..... E01B 25/12

[52] U.S. Cl. ..... 104/130.11

[58] Field of Search ..... 104/130.11; 216/434

[56] References Cited

U.S. PATENT DOCUMENTS

| | | | |
|---|---|---|---|
| 2,997,004 | 8/1961 | Rosenbaum et al. | 104/130.11 |
| 3,093,090 | 6/1963 | Rosenbaum | 104/130.11 |
| 3,472,176 | 10/1969 | Trent | 104/130.11 |
| 5,247,890 | 9/1993 | Mihirogi | 104/130.11 |

*Primary Examiner*—S. Joseph Morano

*Attorney, Agent, or Firm*—Dennison, Scheiner, Schultz & Wakeman

[57] ABSTRACT

A method and device for the elastic bending of a support (16) with at least one bendable end (24), intended in particular for a flexible switch (10). To achieve an elastic line of a finite radius of curvature also at the free end of the support, a bending moment diverging from zero is generated in the elastically bendable end (24) of the support (14) by applying a force coupling to an auxiliary lever (28).

10 Claims, 5 Drawing Sheets a: Elastic line of the outer support under the force F2 b: Elastic line of the interior support under the force F2 c: Elastic line of the outer support under the force F1 d: Elastic line of the outer support resulting from a and c d: Course of the moment at the bendable support by the force F2 e: Course of the moment at the bendable support by the force F1 f: Superimposition of the curves d and e

METHOD AND MEANS FOR THE ELASTIC BENDING OF A SUPPORT FOR A FLEXIBLE SWITCH

FIELD OF THE INVENTION

The invention relates to a method for the elastic bending of a support of a flexible switch with at least one bendable end, wherein the bendable end of the support is moved from a first end position, corresponding to a straight-ahead setting of the flexible switch, into a second end position, corresponding to a branching setting. The invention further relates to a flexible switch with an elastically bendable support, which can be switched from a first end position, which corresponds to a straight-ahead setting of the flexible switch, into a second position, which corresponds to a branching setting, by means of pairs of opposing forces causing the elastic bending of the bendable end.

BACKGROUND OF THE INVENTION

The rail line of a high-speed magnetic train is formed via individual field supports made of steel or concrete. In this case the individual supports themselves can be disposed on level ground or above ground on girders. Flexible steel switches are used so that a moving car can change from one track to another. The switches consist of a steel support of a length of 75 to 150 m, for example, which can be elastically bent with the aid of an electromechanical actuating device. Only individual forces, but no moments, can be transferred to girders of the steel support for generating the bent shape. This means that the bending moment must be linearly limited over the entire length of the steel support and must have a value of zero at the ends of the steel support. It follows from this that the steel support must have a zero curvature at its beginning and end, i.e. a radius of curvature of a. Because of this, a curved steel support has external transitional curved sections in which the radii of curvature increase from oo to a constant value, and a central section following one or several clothoids or an arc of a circle whose radius of curvature corresponds to that of the end sections of the transitional curves. The transitional curves can have a clothoid shape.

A junction often has an undesired length, necessitated by a long elastic line of the elastically bent steel support.

OBJECT AND SUMMARY OF THE INVENTION

It is the object of the present invention to further develop a method for the elastic bending of a steel support for a flexible switch as well as a flexible switch itself in such a way, that the elastic line of the steel support can be adjusted in a controlled manner in its free end area so as to shorten the length of a flexible switch with respect to conventional length switches.

This object is attained in accordance with the invention in that a bending moment diverging from zero is generated in the adjustable end of the support in its curved position. Oppositely oriented elastic lines are created in the course of this, particularly in the free end section of the support, in such a way that an elastic line of a constant curvature deviating from zero is formed.

In further development of the invention it is provided that the bending moment which diverges from zero is generated by means of a lever element to which two opposing forces are applied at the free end.

In accordance with the invention a change in the bending moment in the elastically bent support is caused by means of an auxiliary construction such, that an elastic line is generated, at least in its free pivotable end, which has a constant radius of curvature which diverges from a. Caused by this, the pivotable end area of the support which, in accordance with the prior art has a clothoidal shape, for example, has the shape of an arc of a circle, whose radius corresponds to that of the center section of the support defined as an arc of a circle.

As a result it is possible in connection with a flexible steel switch of the invention to considerably decrease the length of the junction for letting a car change from one track to another track or from one layout of the line to another. In turn this means that the reductions in riding comfort in the area of the junction, which otherwise had to be tolerated, can be reduced.

A flexible switch with an elastically bendable support, which can be moved from a first end position corresponding to a straight-ahead setting of the flexible switch, into a second end position, corresponding to a branching setting, by means of the elastic bending of its bendable end, is distinguished in that a lever element originates at the elastically bendable end of the support or is connected therewith, through which it is possible to transmit forces to the end in its bent end position in such a way, that the support has a curvature diverging from zero in the area of its end. This lever element can in particular be an elastically bendable support extending along the support or continuing past its end, wherein the bendable support and the support extend in planes which are offset in respect to each other.

However, the lever element preferably is an elastically bendable interior support extending within the flexible steel support, wherein the first end of the interior support is fixedly connected with the end of the support in its area which is to be bent and can be displaced with its other (second) free end toward the support.

By means of these measures it is possible, when opposing forces are transmitted to the lever element as well as to the flexible support, to generate elastic lines which are superimposed in the support in such a way that a resulting elastic line having a curvature diverging from zero is created.

A force coupling is preferably established between the second, adjustable end of the bendable support and the fixed support. To accomplish this, it is possible to dispose a drive, such as a hydraulic or a spindle drive, between the second end of the bendable support and the adjacent fixed support, which drive applies opposing forces to cause changes in the distance between them.

Even though the teaching of the invention is intended for steel supports used for high-speed magnetic trains, it can also be realized wherever projecting elements are intended to have a curvature diverging from zero at least in their free end areas.

Further details, advantages and characteristics of the invention not only ensue from the claims, the characteristics to be found therein—either by themselves and/or in combination-, but also from the following description of preferred embodiments to be taken from the drawings.

DETAILED DESCRIPTION OF THE PREFERRED EMBODIMENTS

Figure 1:
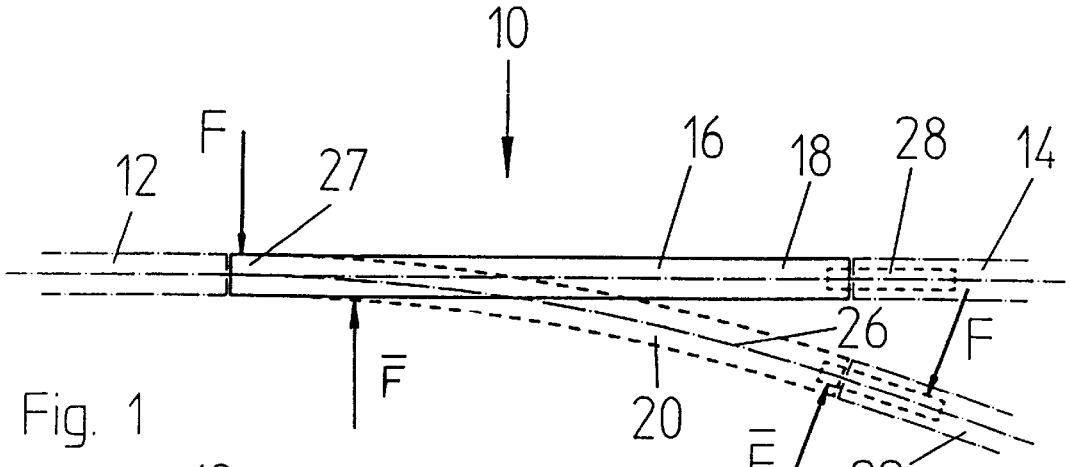
FIG. 1 represents a first embodiment of a flexible steel switch in a top view.

The invention will be explained by reference to the figures, for a flexible steel switch intended, for example, for high-speed magnetic trains.

Tracks for high-speed magnetic trains are formed by lined up supports (12) and (14), consisting of steel or concrete, and these can extend on the level ground or above ground on girders.

If a change from one track to another is to be made, flexible steel supports are employed which consist of a continuous part, such as a steel support (16), which can be elastically bent by means of an electromechanical actuating drive, for example a hydraulic drive applying the opposing forces as indicated in FIGS. 1–4, in order to become aligned, from a straight-ahead setting (18) into a branching setting (20), with another fixed support (22) of a junction.

In accordance with the prior art, the bent steel support must have a specific length and has a curvature in its branching setting in such a way that a clothoidal course is provided in the area of the ends and a curvature course of a constant radius of curvature diverging from ∞ in the center area.

However, to shorten the length of the junction, i.e. the change from one track to the other, it is provided by the invention that a bending moment is generated in the free, elastically bendable end (24) of the steel support (16) in such a way that the elastic line (26), starting at the end (24), has a constant curvature diverging from zero, i.e. that the bent steel support (16) has a line of curvature with a changing radius of curvature only in its fixed end (27) adjoining the support (12), so that the radius of curvature, starting at ∞ makes a steady transition into the desired radius of curvature which is also intended to be present at the free end (24) of the support (16).

To achieve this, a lever element identified as a bendable support (28), originates at the end (24) of the support (16) and extends, in a plane offset in respect to the supports (14) and (16), past the end (24) of the support (16).

To be able to elastically bend the support (16) in the desired amount, one the one hand a fore F and counterforces $\overline{F}$ act at different sides on the support (16) in the area of its end (27) and, on the other hand, a corresponding force F and counterforces F act on the bendable support (28), so that therefore a bending moment diverging from zero is generated in the end (24) of the support (16) and thus an elastic line having a constant radius of curvature.

Figure 2:
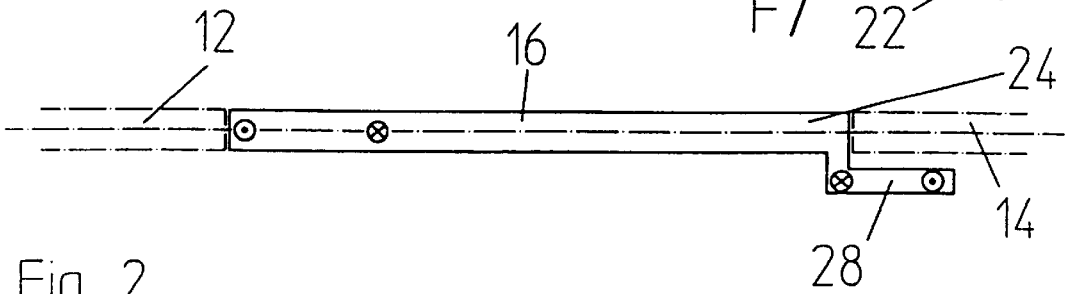
FIG. 2 represents the flexible steel switch of FIG. 1 in a lateral view.

The direction of the forces F, $\overline{F}$ acting on the support (16) or the bendable support (28) have been indicated by dots or crosses in the lateral view in accordance with FIG. 2. In this case a dot identifies a force F extending out of the drawing plane and a cross a force $\overline{F}$ extending into the drawing plane.

Figure 3:
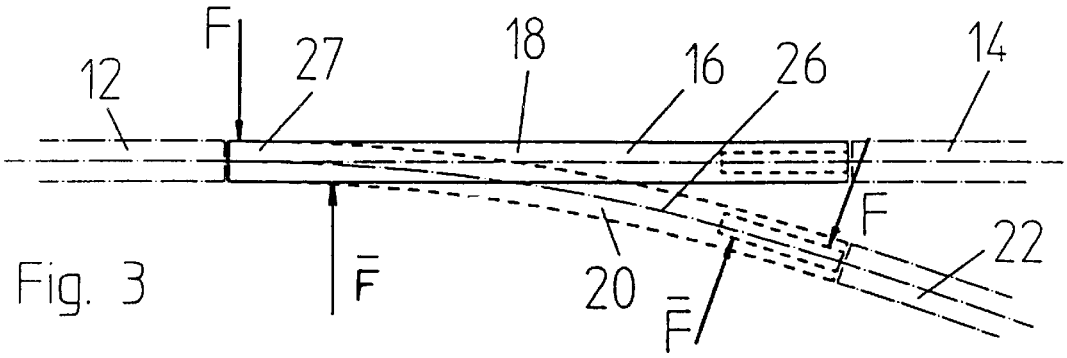
FIG. 3 represents a second embodiment of a flexible steel switch in a top view.
Figure 4:
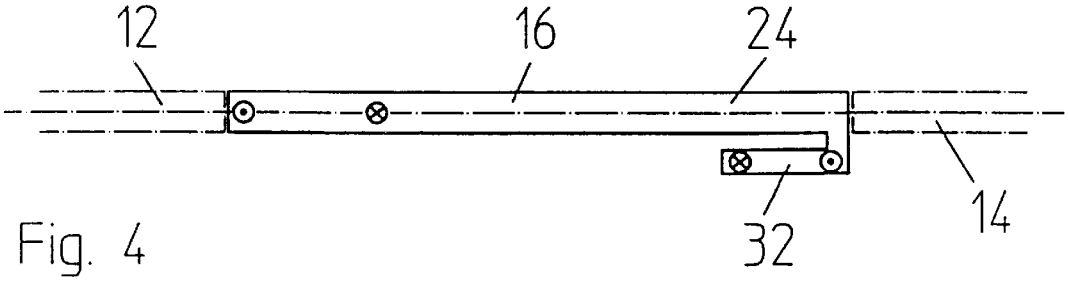
FIG. 4 represents the flexible steel switch of FIG. 3 in a lateral view.
Figure 5:
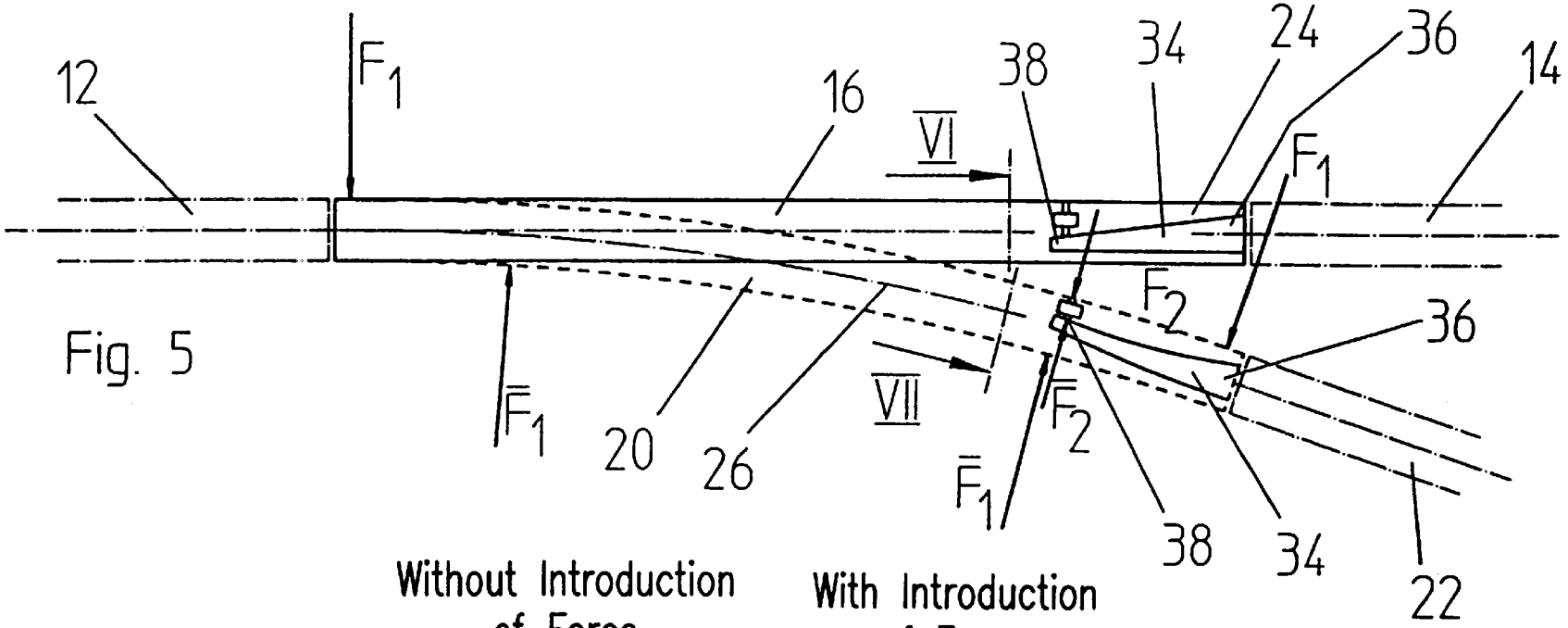
FIG. 5 represents a third embodiment of a flexible steel switch in a top view.

The exemplary embodiment of FIGS. 3 and 4, in which like elements and areas have been provided with the same reference numerals, differs from the one previously shown in that a bendable support (32) generating the bending moment in the end area (24) of the support (16) extends along and below the support (16), starting at the end (24). Caused by this, a force directed away from a force extending in the direction of the straight-ahead setting (18) is generated in the bendable support (32) in the area of its connection with the support (16), instead of the straight-ahead force shown by the example in FIGS. 1 and 2. The force vectors in the area of the free end of the bendable support (28) or (32) correspondingly extend in an opposite direction.

Figure 6:
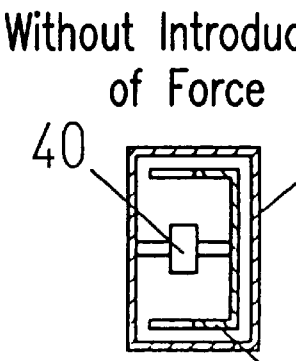
FIG. 6 shows a section along the line VI in FIG. 5.
Figure 7:
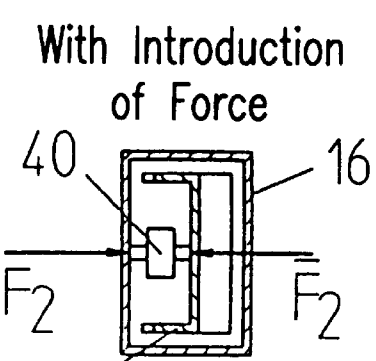
FIG. 7 shows a section along the line VII in FIG. 5.

In FIGS. 1 to 4 the bending moment desired in the area of the end (24) of the support (14) is determined by opposing forces acting on the bendable support (28) or (32). In contrast thereto, in the exemplary embodiment of FIGS. 5 to 10 the desired elastic line (26) is created by external forces $F_1$, $\overline{F}_1$ acting on the bendable support (16), as well by a force $F_2$ acting on a bendable support (34) formed inside the steel support (16). In this case, bendable support (34) has a profiled hollow cross-section as shown in FIGS 6 and 7.

The bendable support (34) is fixedly connected by its one end (36) to the steel support (16), specifically in the area of the end (24) in which it is intended to create a desired bending moment for achieving a constant curvature diverging from zero.

Starting at its end (36), the bendable support (34) which is internal projects away freely, so that its free end (38) can be displaced with respect to the support (16). This takes place when the support (16) is elastically bent under the effect of the forces $F_1$, $\overline{F}_1$ and $F_2$, $\overline{F}_2$. This is also made clear by the cross-sectional representation in FIGS. 6 and 7.

Figure 8:
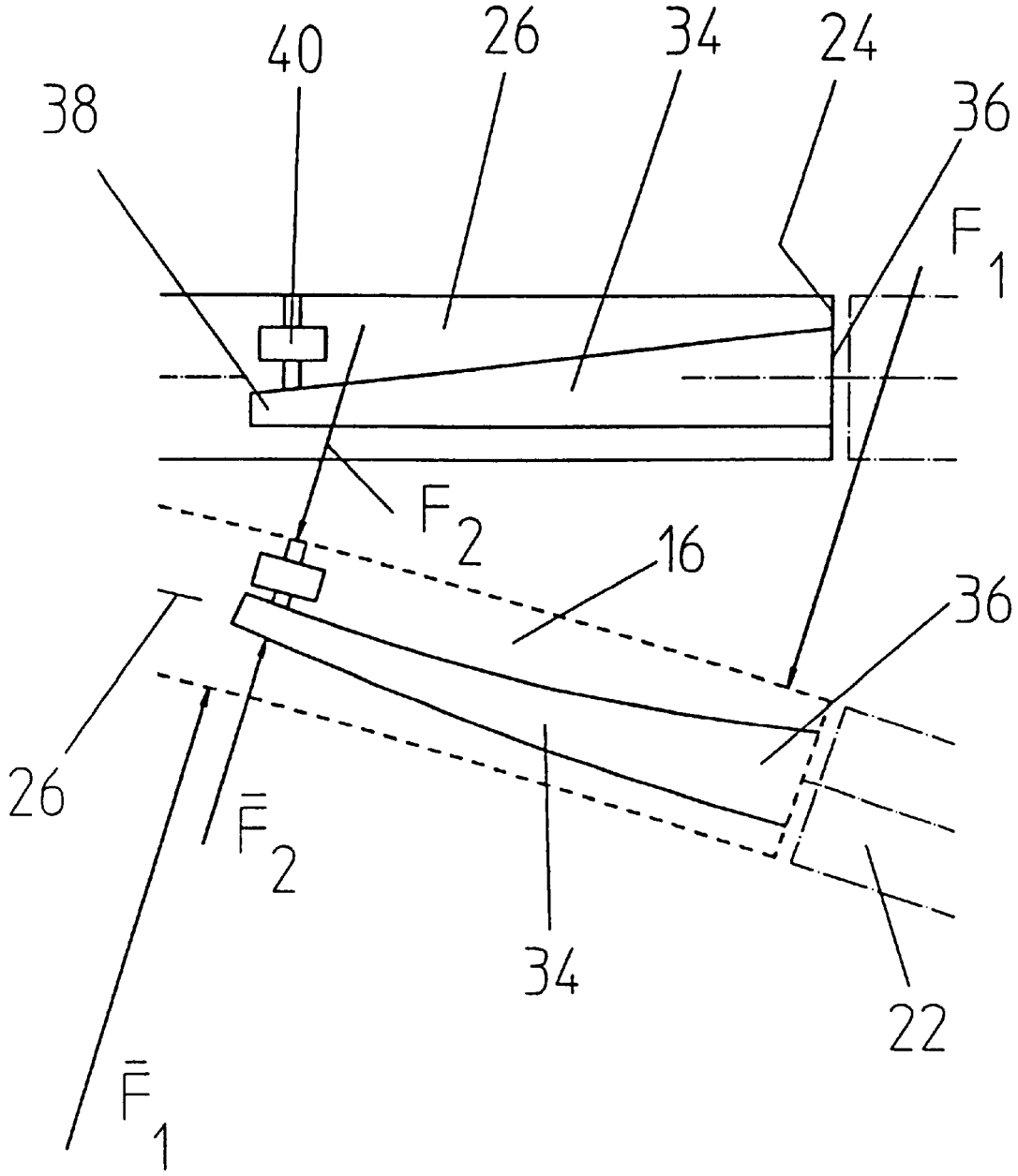
FIG. 8 shows a detail of the flexible steel switch of FIG. 5.

In the embodiment of FIGS. 5–8 force coupling between the free end (38) of the bendable support (34) and the support (16) takes place. Force coupling is realized by known means of force producing devices such as a pair of cylinders, a spindle driven device which produces the forces at the end of a tool. In FIG. 8 the device (40) may operate to pull the end (38) against the wall of steel support (16), note FIG. 7.

Figure 9:
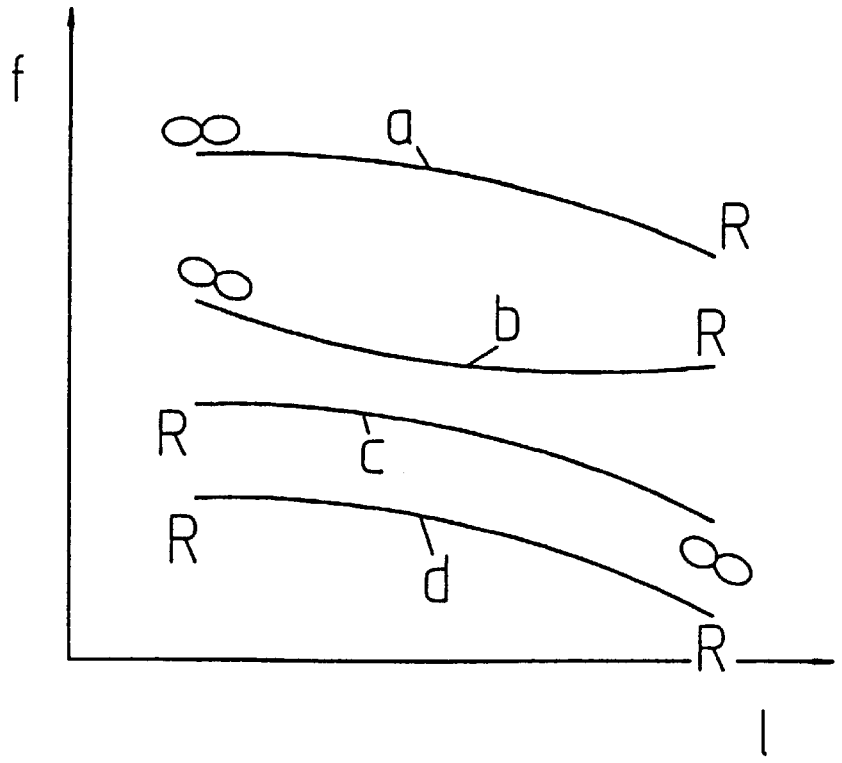
FIG. 9 is a basic representation of the bending lines generated in the flexible steel switch.
Figure 10:
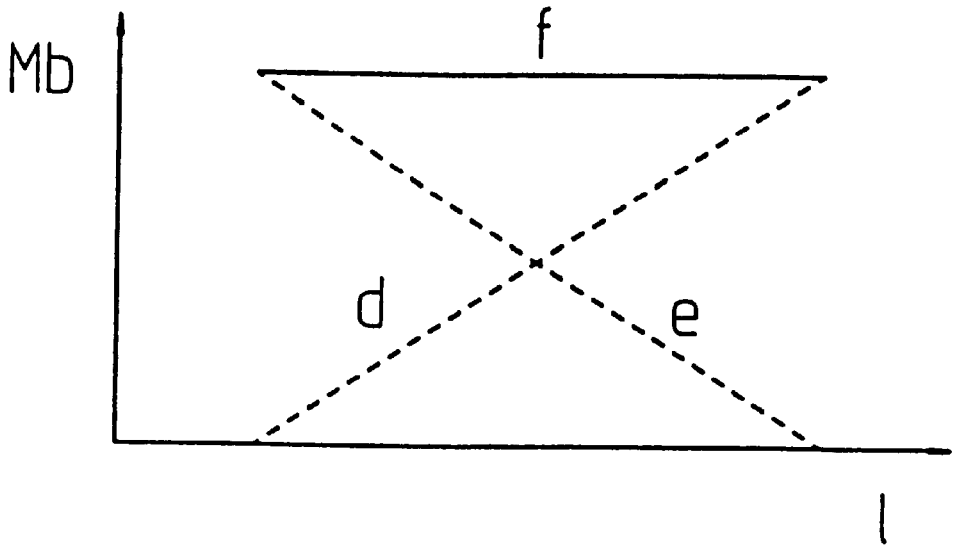
FIG. 10 shows the curves of moments within the flexible steel switch of FIG. 5.

As made clear by means of FIGS. 9 and 10, a plot of moments of constant bending is generated along the bendable internally mounted support (34) and thus in the support (16) by the force and counterforce $F_1$, $\overline{F}_1$ acting on the one hand on opposite sides of the support (16) in the area of its end (24), and on the other hand, by the force $F_2$, and the resulting counterforce $\overline{F}_2$ acting on the interior support (34) which forms a projecting arm extending inside the support (16). The force $F_2$ does not have to be generated within the bendable support (16) as shown in FIG. 8, but can also come from a location outside of it.

In FIG. 9 the bend f has been plotted with respect to the length l within which the interior support (34) extends in the support (16).

If only exterior forces $F_1$, $\overline{F}_1$ act on the support (16), an elastic line c FIG. 9 results in a customary way, which can have a clothoidal course, i.e. has a radius of curvature of ∞ in the area of the outer end (24) of the support (16), which makes a continuous transition into a radius of curvature R (curve c).

If the forces $F_2$, $\overline{F}_2$ act on the free end (38) of the interior support (34), the interior support (34) has a course of curvature which is expressed by the curve b FIG 9. In the area where the force $F_2$, $\overline{F}_2$ acts and where the bending moment is zero, the radius of curvature is m and decreases to the radius R in the direction toward the fixed end (36) of the interior support (34).

A force $F_2$ emanating from the support (16) counteracts the force $\overline{F}_2$ acting on the end (38) of the interior support (34). By means of the force $F_2$, $\overline{F}_2$ an elastic line is generated in the bendable steel support (16), which corresponds to the curve a, i.e. which has a radius of curvature of ∞ in the area of the force application and a radius of curvature R in the area of the end.

A superimposition of all elastic lines a, b and c now leads to a resultant which has a constant radius of curvature R (elastic line d) over its entire length.

This can be seen from the plot of the moments in FIG. 10. A course of moment is generated in the support by the force $F_2$, $\overline{F}_2$, which corresponds to the dashed curve d, i.e. has a bending moment of zero in the point of application of the force $F_2$, $\overline{F}_2$ and a value f at the end (24).

The course of the moment is opposite when the force $F_1$, $\overline{F}_1$ alone acts on the support (16). In the area of the end (24), the bending moment is zero and increases with an increasing distance from the end (24). Therefore a total bending moment is generated as the resultant over the entire length which is constant and represented by the solid line f.

The elastic line (26) which has a constant radius of curvature R diverging from the infinite is formed in the free end area of the support (16) because of the constant bending moment diverging from zero.

What is claimed is:

1. A method for the elastic bending of a steel support (16) having a predetermined length and forming part of a flexible switch, the support having a fixed end and a bendable end (24), wherein the bendable end can be moved from a first, straight-ahead setting (18) to a second, branching setting (20) the method comprising:

connecting a lever element (28, 32) to the bendable end of the steel support, applying a pair of opposing forces to the ends of said lever element so that the steel support is bent along the entire length according to a changing radius of curvature beginning at the fixed end with an infinite value and at the bendable end with a predetermined value.

2. A method in accordance with claim 1, wherein said forces moving the bendable end from the first setting to the second setting generate a bending moment in said steel support which diverges from zero substantially along the entire steel support length, including the bendable end.

3. In a flexible switch (10) where a support having a first, fixed end and a second end (24) can be switched from a first position, which corresponds to a straight-ahead setting (18) into a second position, which corresponds to a branching setting (20) comprising:

a steel support (16) which is elastically bendable, the steel support having a predetermined length, a first, fixed end (27) and a second end (24), and means for causing elastic bending so that the steel support is bent along the entire length according to a changing radius of curvature beginning at the first, fixed end with a value of infinity and at the second end, with a finite predetermined value.

4. The flexible switch in accordance with claim 3, wherein the means for causing elastic bending includes:

a lever element (28, 32, 34) attached to the second end (24) of the steel, support, and a device (40) by which opposing forces are applied to said lever element to cause bending the second end from the first position to the second position, said opposing fores generating a bending moment in the steel support which diverges from zero substantially along the entire length of the steel support including the second end.

5. The flexible switch in accordance with claim 4, wherein the lever element (28, 32) is formed so as to extend along the steel support (16) and projecting from said second end, said lever element and the steel support extend in planes which are offset from each other.

6. The flexible switch in accordance with claim 4 wherein the lever element is formed as an elastically bendable interior support (34) extending from inside the support (16), said elastically bendable interior support has a first end (36) fixedly connected to the steel support (16) near the second end (24) of the steel support so that it can be displaced toward a wall of the steel support with its second end (38).

7. The flexible switch in accordance with claim 6, wherein said means causing elastic bending includes a force coupling between the second end (38) of the interior support (34) and the steel support (16).

8. The flexible switch in accordance with claim 7, wherein said means causing elastic bending has the device (40) disposed between the second end (38) of the interior support (34) and an interior wall near the end of the steel support which device operates to change the distance between the end (38) and the steel support interior wall.

9. The flexible switch in accordance with claim 8, wherein the level element (28, 32, 34) is an outwardly projecting arm, one end of which is connected with the second end (24) of the support.

10. The flexible switch in accordance with claim 8, wherein said device (40) is a hydraulic operated device.

* * * * *